US007648251B2

(12) United States Patent
Whitehouse et al.

(10) Patent No.: US 7,648,251 B2
(45) Date of Patent: Jan. 19, 2010

(54) STRIP LIGHTING ASSEMBLY

(75) Inventors: Bruce Whitehouse, Milton (CA); Webb Jim, Milton (CA); Ting On Wong, Niagra Falls (CA)

(73) Assignee: Amdor, Inc., Burlington (CA)

( * ) Notice: Subject to any disclaimer, the term of this patent is extended or adjusted under 35 U.S.C. 154(b) by 90 days.

(21) Appl. No.: 11/798,648

(22) Filed: May 16, 2007

(65) Prior Publication Data

US 2008/0285264 A1 Nov. 20, 2008

Related U.S. Application Data

(60) Provisional application No. 60/800,026, filed on May 15, 2006.

(51) Int. Cl.
*F21S 4/00* (2006.01)
*F21V 33/00* (2006.01)

(52) U.S. Cl. ..... 362/223; 362/133; 362/249.03

(58) Field of Classification Search ..... 362/555, 362/125, 134, 217, 219, 220, 222, 223, 249, 362/250, 285, 287, 235, 232, 233, 238, 372, 362/133

See application file for complete search history.

(56) References Cited

U.S. PATENT DOCUMENTS 5,103,382 A * 4/1992 Kondo et al. ..... 362/503
5,246,054 A * 9/1993 Shepherd et al. ..... 160/133
6,736,525 B2 * 5/2004 Chin ..... 362/249
6,882,111 B2 * 4/2005 Kan et al. ..... 315/122
7,014,337 B2 * 3/2006 Chen ..... 362/240
7,052,171 B1 * 5/2006 Lefebvre et al. ..... 362/649
2005/0265019 A1 * 12/2005 Sommers et al. ..... 362/217
2007/0133202 A1 * 6/2007 Huang et al. ..... 362/235
2008/0094837 A1 * 4/2008 Dobbins et al. ..... 362/249

FOREIGN PATENT DOCUMENTS

JP 03000014 A * 1/1991

* cited by examiner

*Primary Examiner*—Ismael Negron
*Assistant Examiner*—David R Crowe
(74) *Attorney, Agent, or Firm*—Steven M. Greenberg, Esq.; Carey Rodriguez Greenberg & Paul LLP

(57) ABSTRACT

A strip light assembly including an elongated light carrying member with a series of lights extending along the length thereof, and an elongated translucent tubular cover member in which the light carrying member is removably slidably mounted, the interior of the cover member having radially spaced internal projections positioned to receive the light carrying member therebetween to maintain the light carrying member in selectable different angular orientations in the cover member.

3 Claims, 10 Drawing Sheets

STRIP LIGHTING ASSEMBLY

RELATED APPLICATION

This application claims priority from U.S. Provisional Patent Application No. 60/800,026 filed May 15, 2006.

FIELD OF INVENTION

This invention relates to strip lighting assemblies.

BACKGROUND OF THE INVENTION

Strip lighting assemblies are used in many different environments. Sometimes it is desirable to be able to readily adjust the angular orientation of the light produced by a strip lighting assembly. Although various ways of doing this have been previously proposed, such prior proposals have not proved to be particularly commercially successful.

It is therefore an object of this invention to provide a strip lighting assembly with which the angular orientation of the light produced can be readily angularly adjusted.

SUMMARY OF THE INVENTION

According to the invention, a strip lighting assembly includes an elongated light carrying member with a series of lights extending along the length thereof, and an elongated translucent tubular cover member in which the light carrying member is removably slidably mountable. The interior of the cover member has radially spaced internal projections positioned to receive the light carrying member therebetween to maintain the light carrying member in selectable different angular orientations in the cover member.

A storage compartment having a vertically moving door may have a pair of such strip lighting assemblies mounted in the storage compartment and extending vertically therein adjacent respective opposite sides of the door interiorly thereof. The cover members of the strip lighting assemblies may be secured to respective door frame members.

DESCRIPTION OF THE DRAWINGS

Embodiments of the invention will now be described, by way of example, with reference to the accompanying drawings, of which.

DESCRIPTION OF PREFERRED EMBODIMENTS

Figure 1:
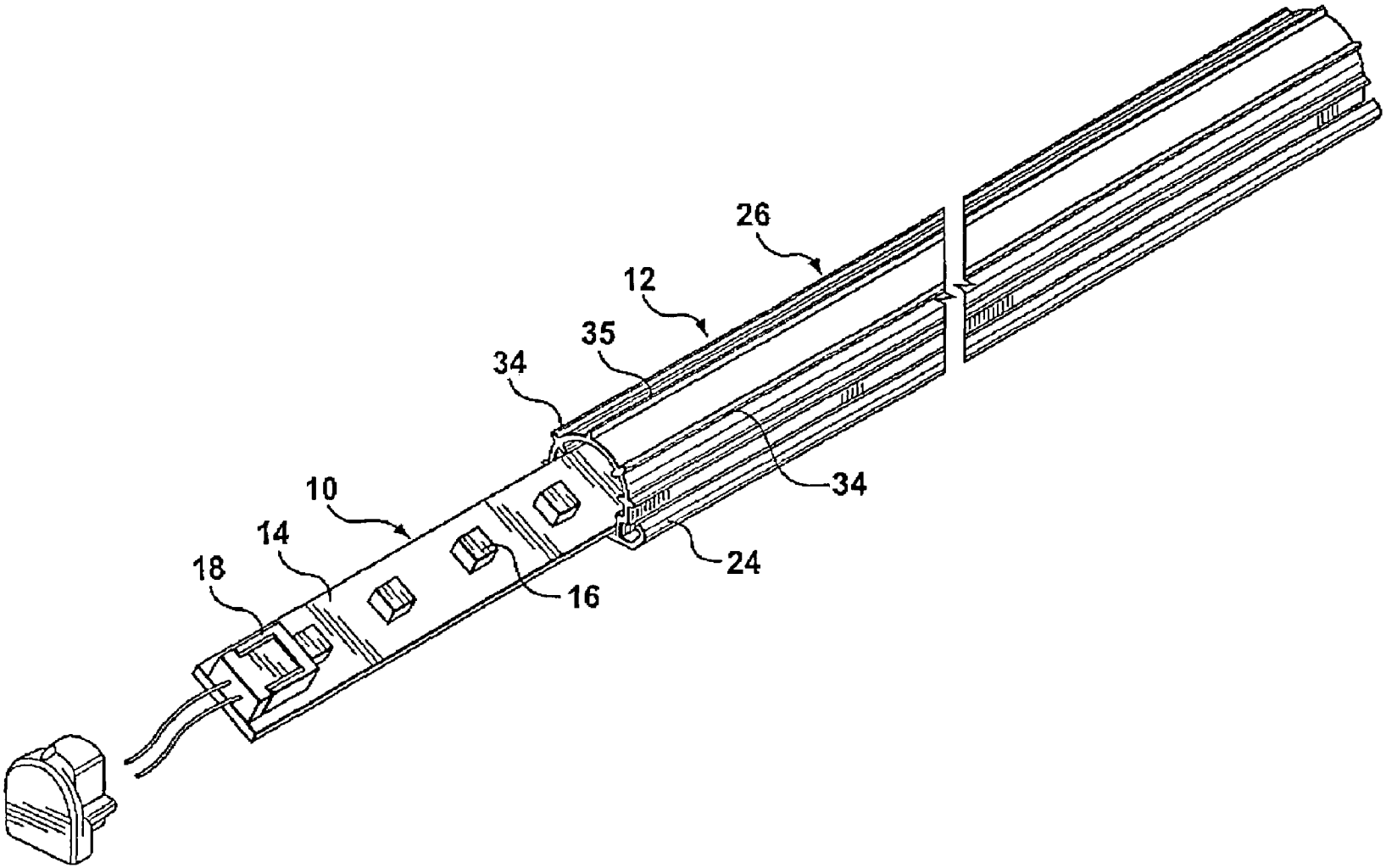
FIG. 1 is a perspective view of a light carrying member partially inserted into a cover member at a pre-determined angular orientation relative thereto in accordance with one embodiment of the invention.
Figure 2:
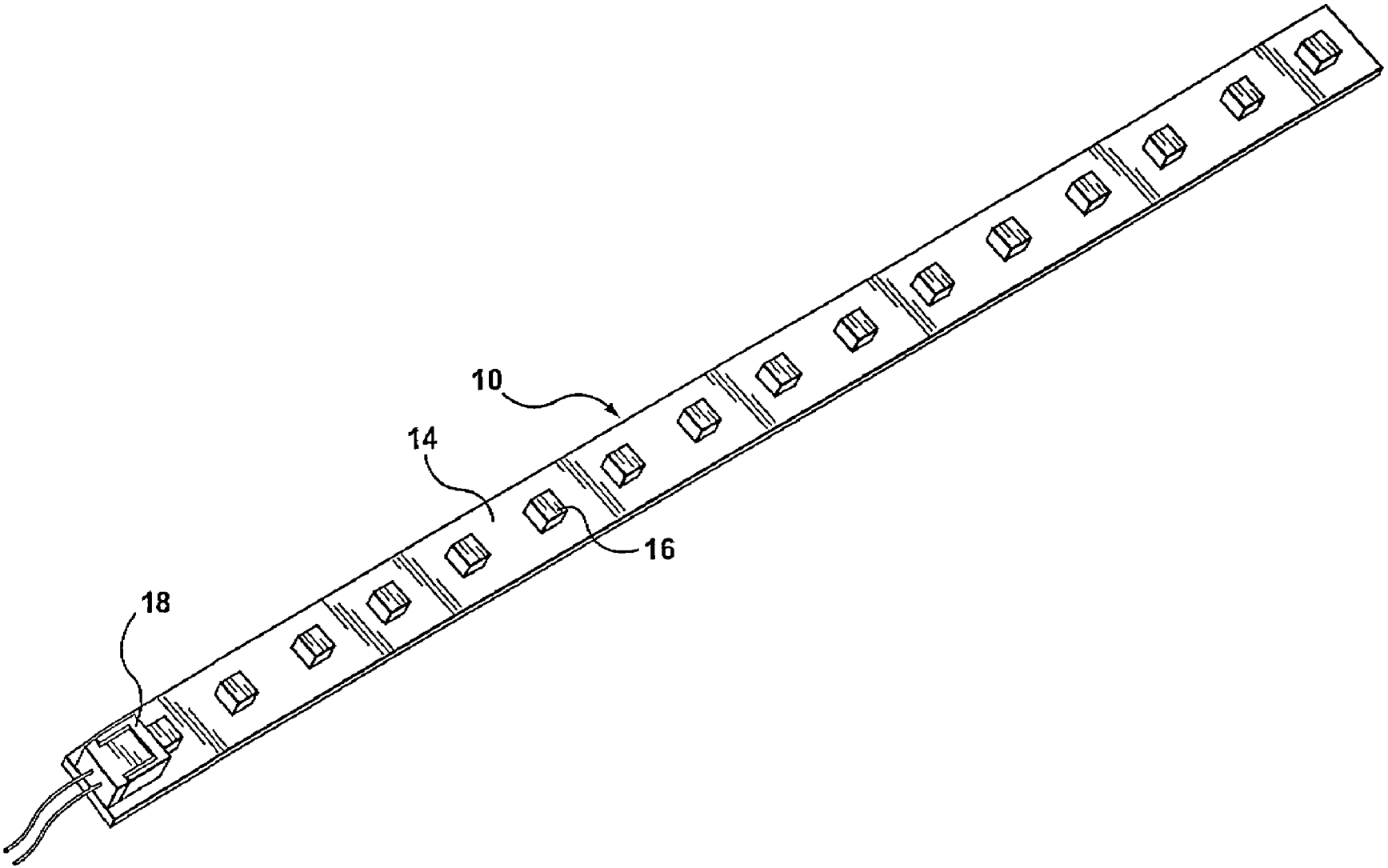
FIG. 2 is a similar view of the light carrying member alone.

Referring first to FIGS. 1 and 2 of the accompanying drawings, a strip light assembly comprises an elongated light carrying member 10 and an elongated translucent tubular cover member 12. The light carrying member 10 has an elongated body member 14 with a series of LED lights 16 spaced therealong. The LED lights 16 are electrically connected to an electrical power receiving socket 18 at one end.

Figure 3:
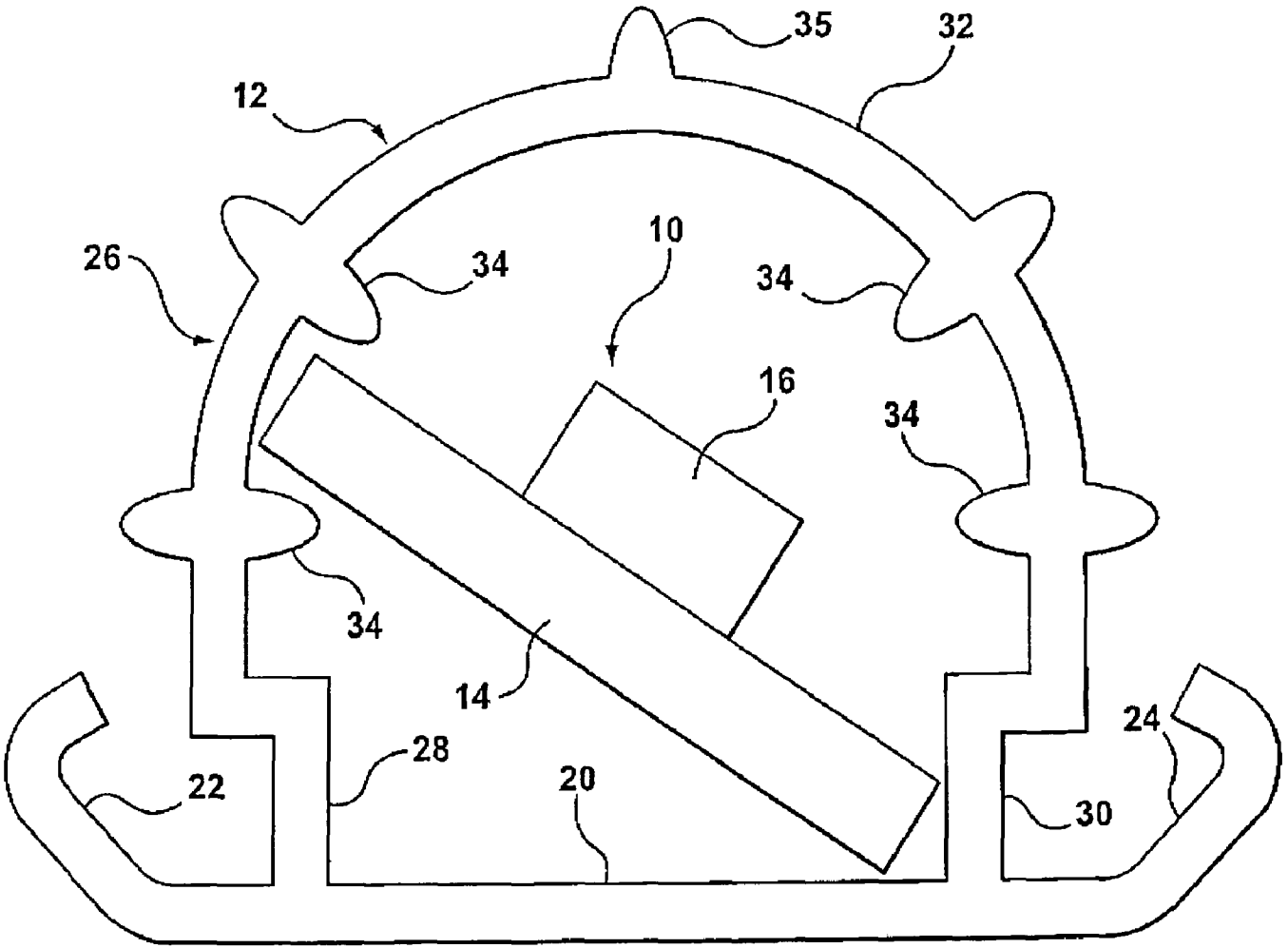
FIG. 3 is a diagrammatic end view showing an angular orientation of the light carrying member in the cover member.
Figure 4:
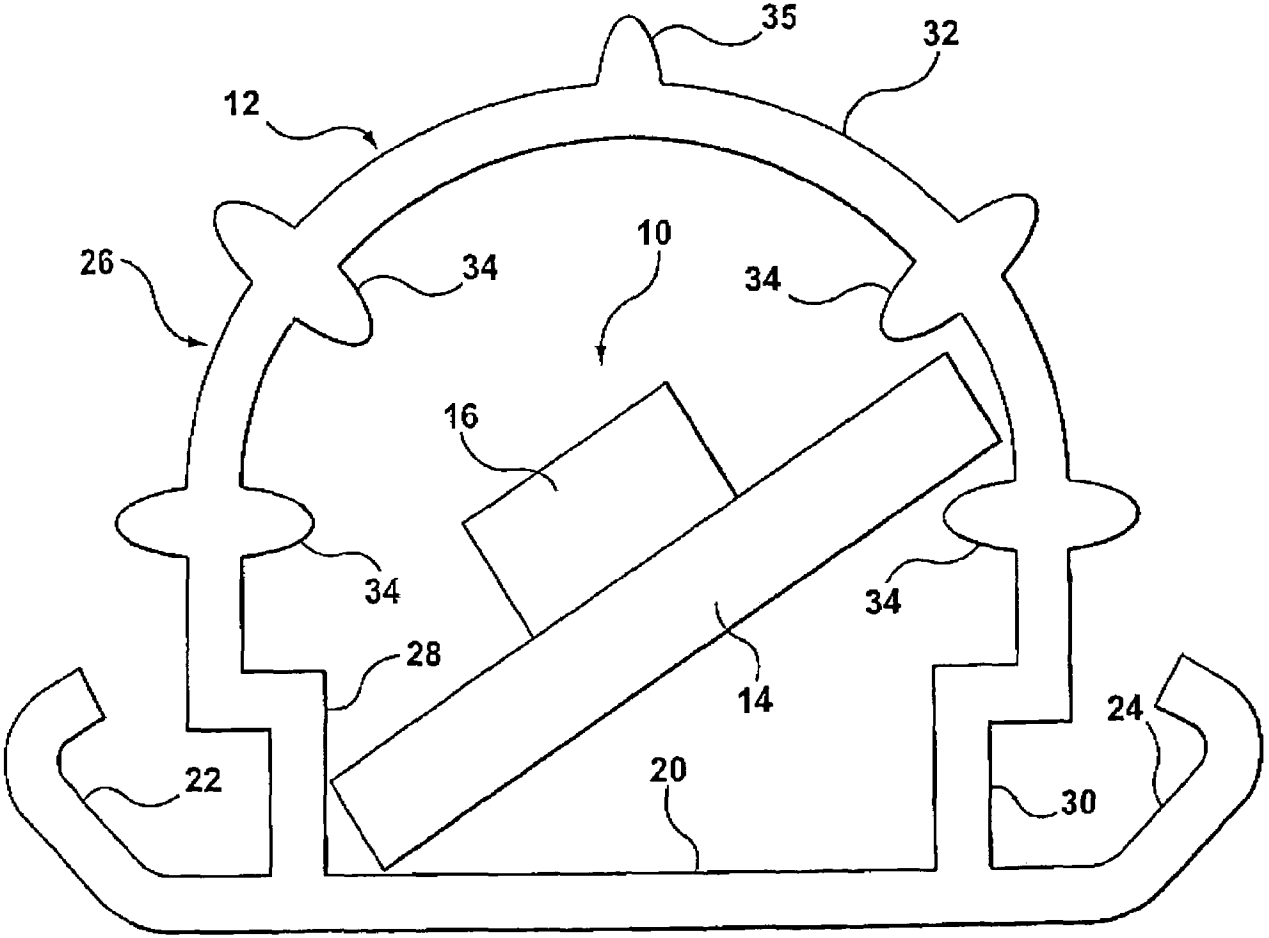
FIG. 4 is similar to FIG. 3 but showing the light carrying member in another angular orientation in the cover member.
Figure 5:
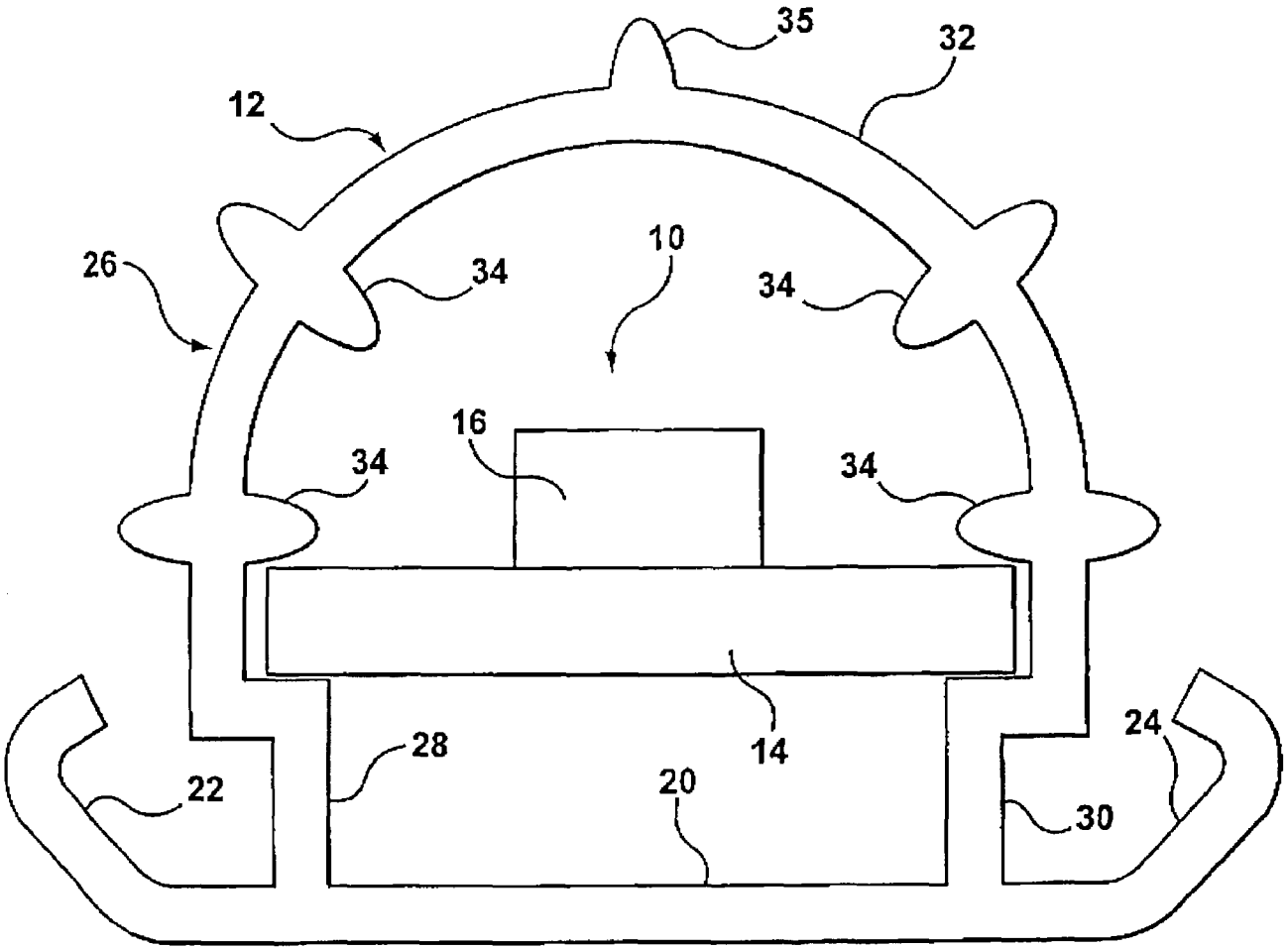
FIG. 5 is similar to FIGS. 3 and 4 but shows the light carrying member in yet another angular orientation in the cover member.

Referring now also to FIGS. 3, 4 and 5, the cover member has a longitudinally extending base portion 20 with upward inclined side portions 22, 24. A cover portion 26 extends upwardly from the central part of the base portion 20. The cover portion 26 has a lower part with a pair of transversely spaced walls 28, 30 and a dome part 32 extending between the side walls 28, 30. The dome part 32 has radially spaced ribs 34 which project inwardly and outwardly. The inwardly projecting parts of the ribs 34 support the light carrying strip member 10 in different angular orientations, as will be described shortly. The inwardly and outwardly projecting parts of the ribs 34 also serve to strengthen the dome portion 32 against impact damage and also function to assist in producing a desired light pattern from the LED lights 16. It will be noted that the dome portion 32 also has an outwardly projecting rib 35 at the top for these last-mentioned purposes.

Figure 6:
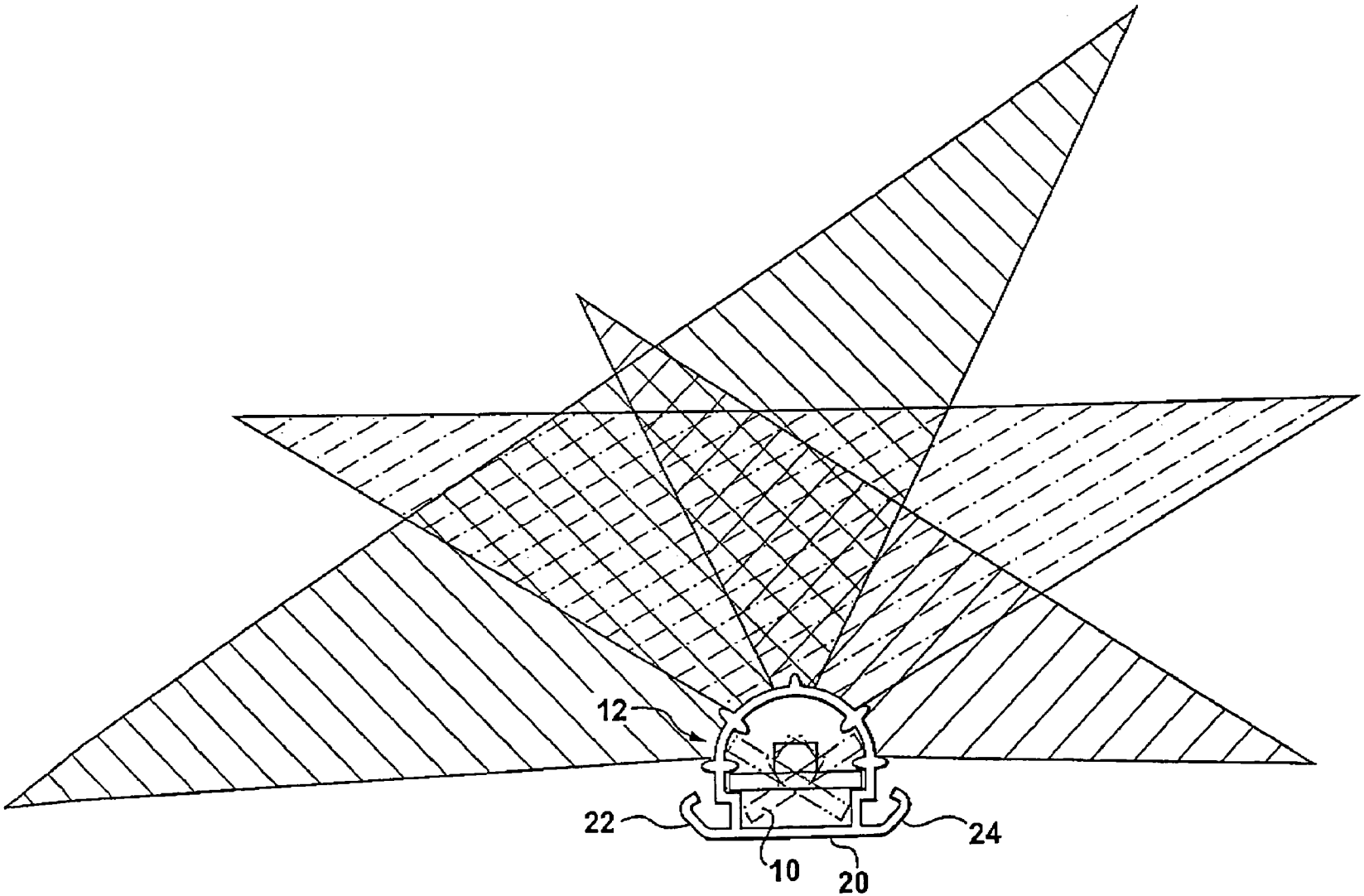
FIG. 6 is an end view showing the light patterns produced by the light carrying member when in various angular orientations in the cover member.

FIG. 3 shows the strip member 10 located in the cover member 12 at a first inclined angle. FIG. 4 shows the strip member 10 located in the cover member 12 at another inclined angle, and FIG. 5 shows the strip member 10 located horizontally in the cover member 12. FIG. 6 shows the different light patterns which can be obtained by mounting the strip member 10 in the different angular orientations just described.

Figure 7:
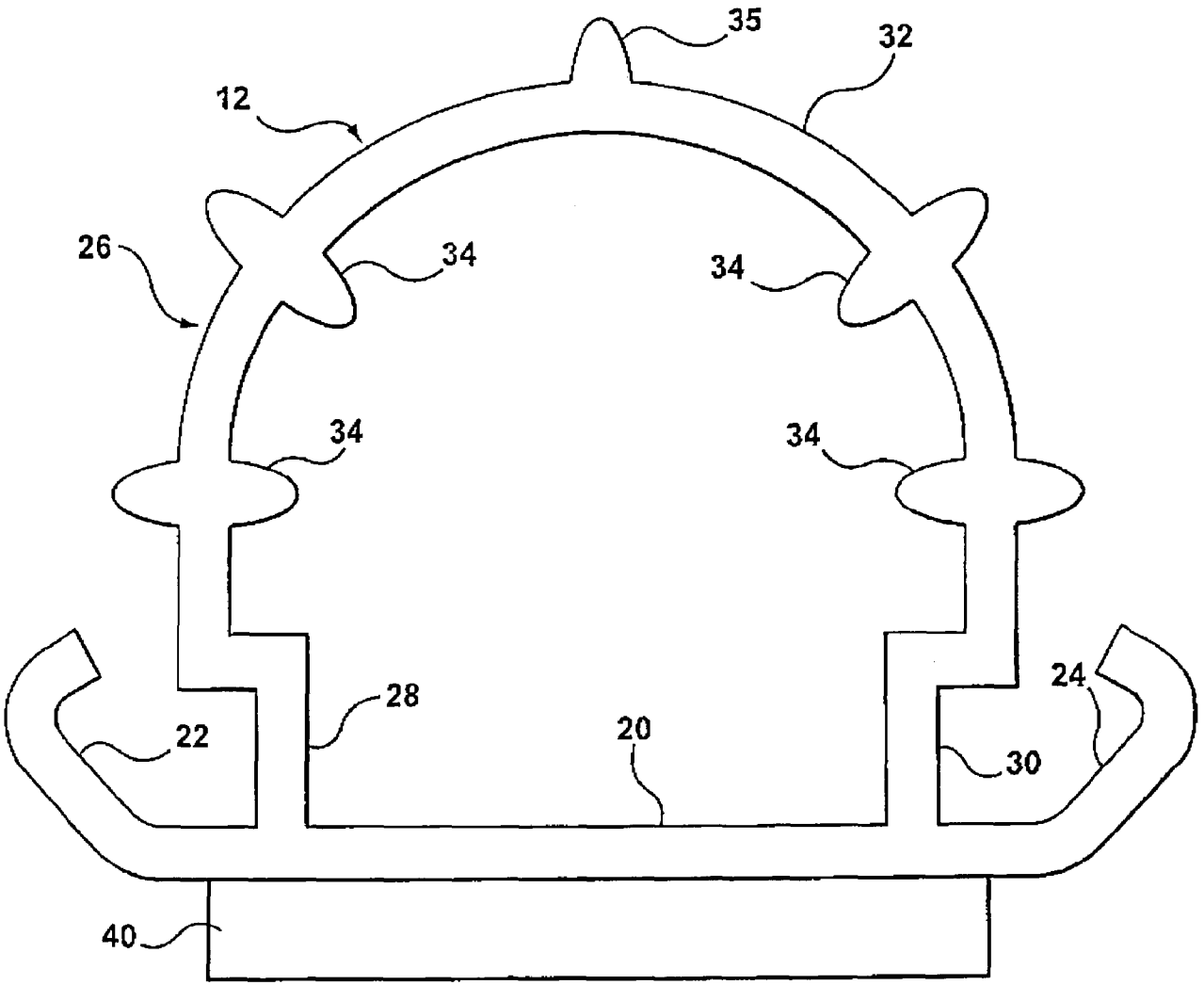
FIG. 7 is an end view showing the cover member mounted on a suitable support.
Figure 8:
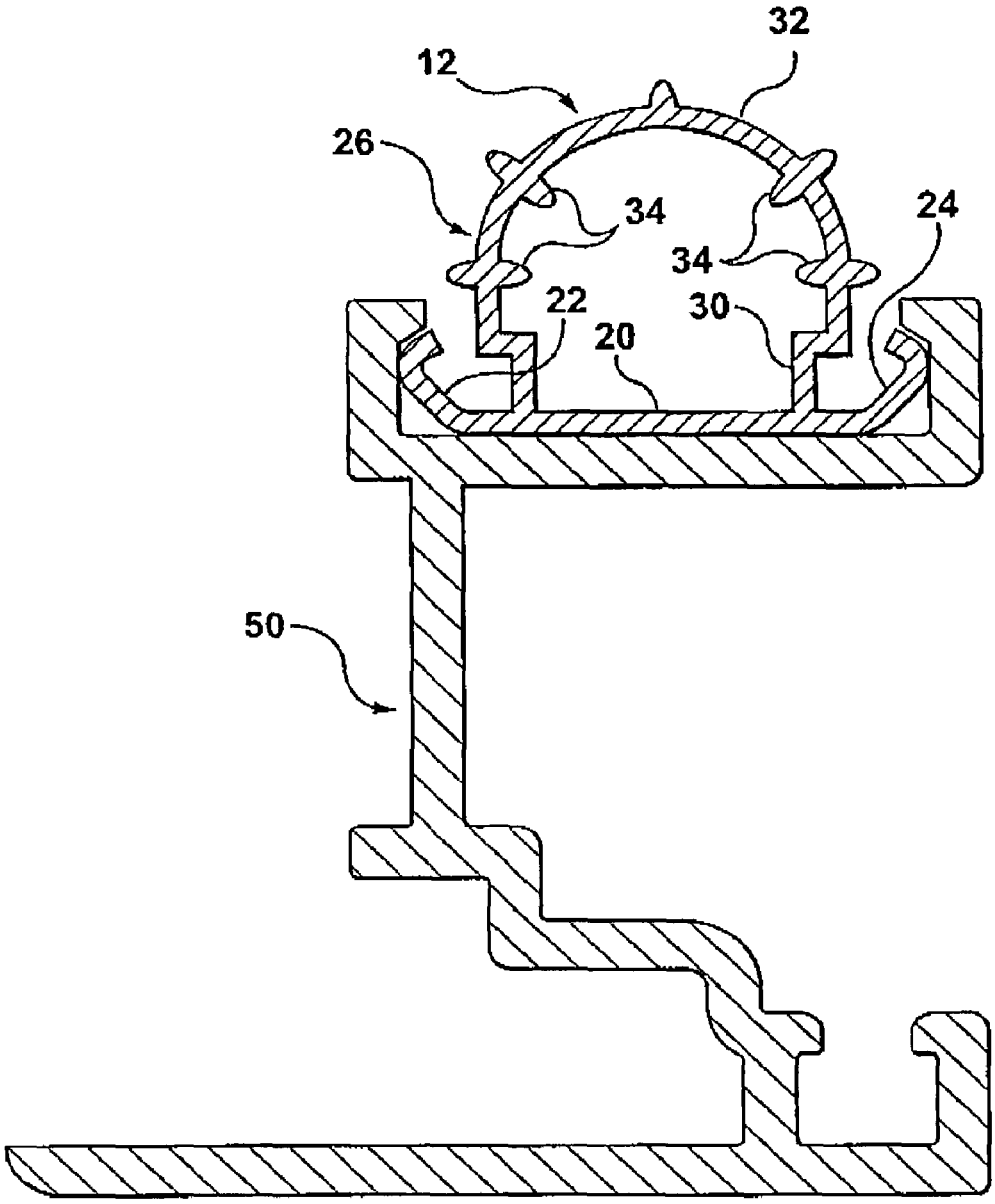
FIG. 8 is an end view showing the cover member fitted in a mounting strip.
Figure 9:
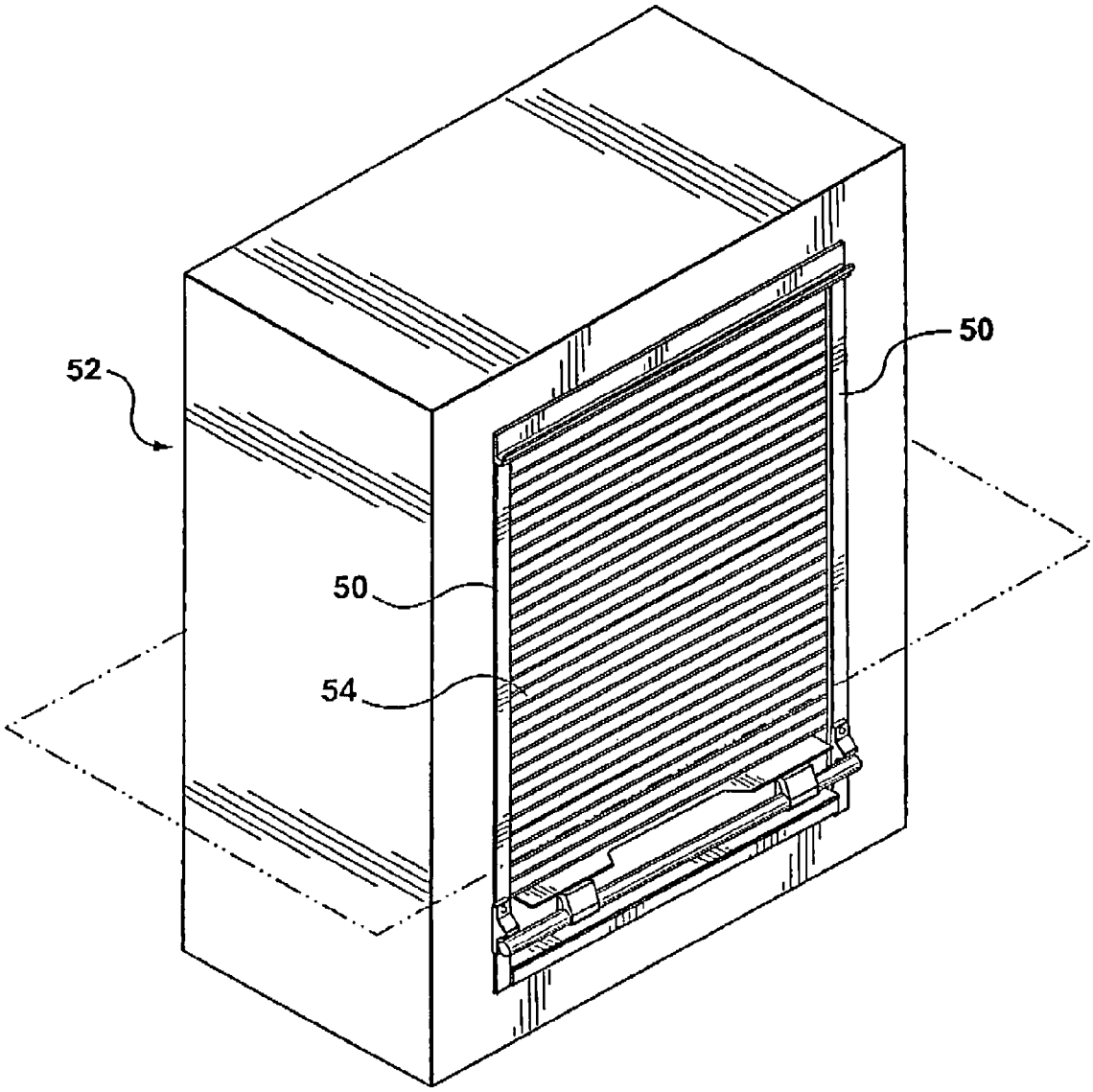
FIG. 9 is a perspective view of a storage cabinet.
Figure 10:
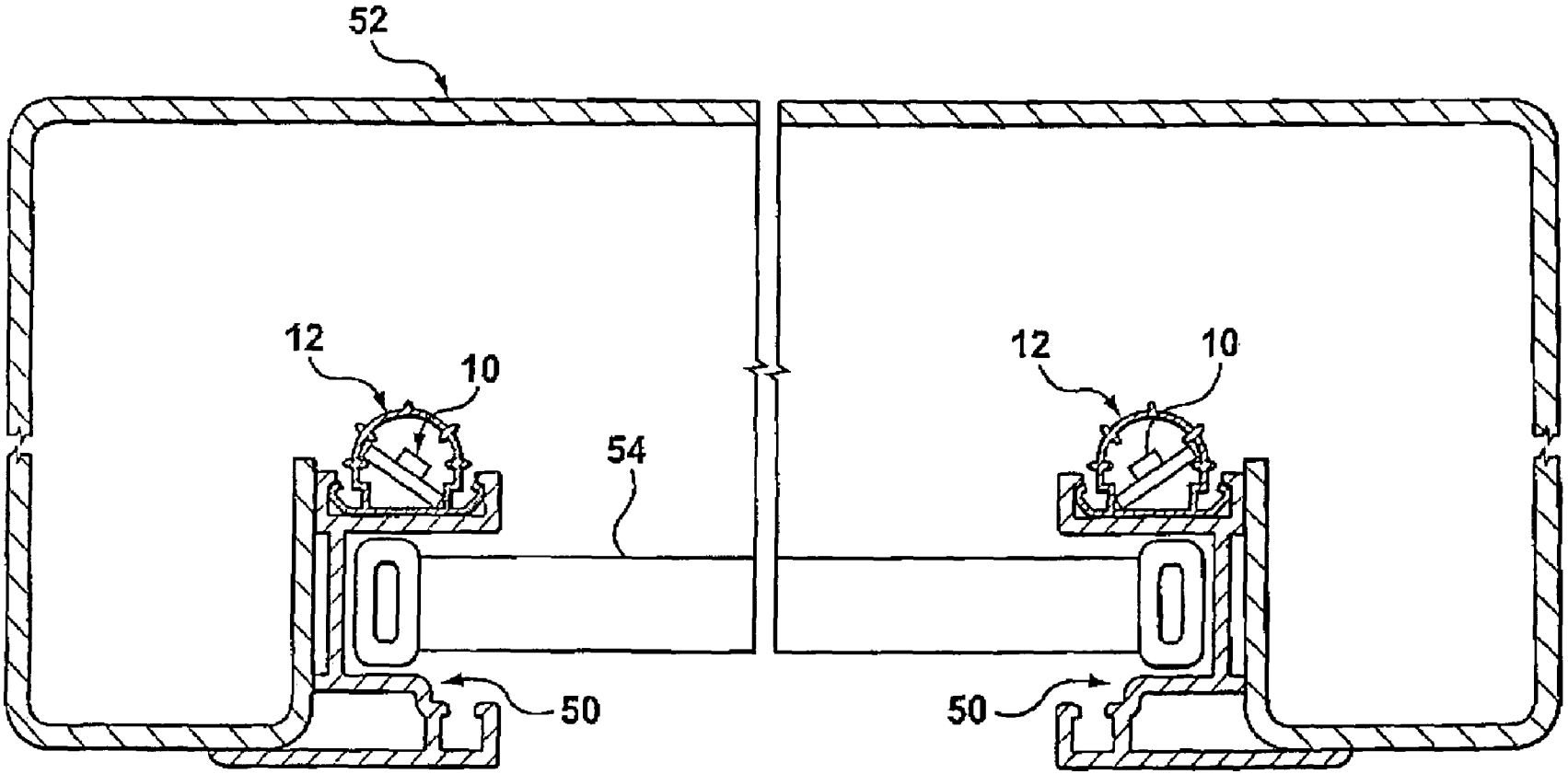
FIG. 10 is a horizontal sectional view showing two light strip assemblies in accordance with the invention mounted therein to illuminate the interior.

FIG. 7 shows how the cover member 12 can be mounted on a simple base member 40, and FIG. 8 shows how the cover member 12 can be mounted on a door frame member such as a bracket 50 for installation in a location where such a bracket is required. FIGS. 9 and 10 show such an installation, namely in a storage compartment 52 with a vertically movable door 54. The sides of the door 54 slide in the brackets 50 in the manner shown in FIG. 10, which also shows two light strip assemblies in accordance with the invention mounted vertically in the brackets 50 in the manner shown in FIG. 8, i.e. with the cover members 12 secured to the respective brackets 50 adjacent opposite sides of the door 54.

The advantages of the invention and other embodiments thereof will now be readily apparent to a person skilled in the art.

The invention claimed is:

1. A strip light assembly including an elongated light carrying member with a series of lights extending along a length thereof, and an elongated translucent tubular cover member in which the light carrying member is removably slidably mounted;

the cover member comprising:

a longitudinally extending generally planar base portion; and a cover portion extending from the base portion, the cover portion comprising:

a pair of transversely spaced side walls extending from the base portion to define opposed corners between the base and each side wall; and a dome extending from a top edge of one of the side walls to a top edge of a second one of the side walls, the dome comprising a concave interior surface and a convex exterior surface;

the interior surface of the dome having radially spaced internal projections extending from the interior surface and positioned to receive the light carrying member therebetween, the radially spaced internal projections cooperating with the opposed corners to maintain the light carrying member in the cover member in selectable different angular orientations relative to the base portion.

2. A storage compartment comprising:

a vertically movable door; and a pair of strip light assemblies, each of the strip light assemblies including an elongated light carrying member with a series of lights extending along a length thereof, and an elongated translucent tubular cover member in which the light carrying member is removably slidably mounted;

the cover member comprising:

a longitudinally extending generally planar base portion; and a cover portion extending from the base portion, the cover portion comprising:

a pair of transversely spaced side walls extending from the base portion to define opposed corners between the base and each side wall; and a dome extending from a top edge of one of the side walls to a top edge of a second one of the side walls, the dome comprising a concave interior surface and a convex exterior surface;

the interior surface of the dome having radially spaced internal projections extending from the interior surface and positioned to receive the light carrying member therebetween, the radially spaced internal projections cooperating with the opposed corners to maintain the light carrying member in the cover member in selectable different angular orientations relative to the base portion;

wherein the pair of strip light assemblies are mounted in the storage compartment and extend vertically therein adjacent respective opposite sides of the vertically movable door interiorly thereof.

3. A storage compartment according to claim 2 wherein the cover members of the strip light assemblies are secured to respective door frame members.

* * * * *